US008485424B1

(12) United States Patent
Taylor

(10) Patent No.: US 8,485,424 B1
(45) Date of Patent: Jul. 16, 2013

(54) REVERSIBLE SECURITY MAILBOX

(76) Inventor: Gary L. Taylor, Escondido, CA (US)

( * ) Notice: Subject to any disclaimer, the term of this patent is extended or adjusted under 35 U.S.C. 154(b) by 0 days.

(21) Appl. No.: 13/474,630

(22) Filed: May 17, 2012

(51) Int. Cl.
*B65G 11/04* (2006.01)

(52) U.S. Cl.
USPC ..... 232/47; 232/17; 232/38; 232/45

(58) Field of Classification Search
USPC ..... 232/17, 45, 47, 49–52, 38, 43.1, 232/44; 220/4.26, 4.27, 4.28, 4.33
See application file for complete search history.

(56) References Cited

U.S. PATENT DOCUMENTS

| | | | | | |
|---|---|---|---|---|---|
| 476,971 | A | * | 6/1892 | Askam | 232/49 |
| 1,480,452 | A | * | 1/1924 | Kolstad | 232/17 |
| 1,793,466 | A | * | 2/1931 | Cox | 232/7 |
| 3,880,344 | A | * | 4/1975 | Earle | 232/17 |
| 5,207,377 | A | * | 5/1993 | Brecht | 232/17 |
| D398,134 | S | | 9/1998 | Taylor | |
| 5,938,113 | A | * | 8/1999 | Kim | 232/47 |
| 6,109,519 | A | * | 8/2000 | McClure | 232/17 |
| 6,234,388 | B1 | | 5/2001 | Taylor | |
| 6,375,071 | B1 | * | 4/2002 | Kim | 232/47 |
| 6,644,542 | B2 | * | 11/2003 | Cox et al. | 232/47 |
| 6,953,149 | B2 | | 10/2005 | Taylor | |
| D589,675 | S | * | 3/2009 | McFadden et al. | D99/32 |

* cited by examiner

*Primary Examiner* — William L. Miller
(74) *Attorney, Agent, or Firm* — Palomar Patent; Calif Tervo

(57) ABSTRACT

A security mailbox secures mail deposited therein from theft and protects its contents from the elements by having a receiving section including a receiving chamber for receiving mail through a mail delivery opening in its front end, a securing section including a securing chamber for receiving mail from the receiving chamber, and a teeter baffle separating the receiving chamber from the securing chamber. The securing chamber has an access door for selectively accessing delivered mail items secured therein. A portion of the securing section pecincluding the access door is selectably attachable to the remainder of the mailbox such that the access door can be on the front or the back of the mailbox. Fasteners accessible only through the access door attach the top end of the securing section to the remainder of the mailbox.

15 Claims, 2 Drawing Sheets

REVERSIBLE SECURITY MAILBOX

FIELD OF THE INVENTION

This invention relates to a security enclosure, such as a mailbox, which prevents the theft or the destruction of the mail and packages deposited therein, and more particularly to a secure mailbox adapted for removing items from either the front or back.

BACKGROUND OF THE INVENTION

My previous U.S. Pat. No. 6,234,388, describes a security mailbox wherein deposited items remain out of reach and out of view to unauthorized persons, and which will hold more than several days' mail deliveries.

One shortcoming of this mailbox is that the mail is only removable from either the front or the back. Since there are installations that may require one or the other or if an installation requiring one is changed to an installation requiring the other, then the mailbox cannot be used.

Another shortcoming of this mailbox is that it is large and awkward to ship.

Therefore, there has been a need, for an improved security mailbox that can be adapted for either front or back mail retrieval and, preferably, concurrently provides a more desirable shipping profile without sacrificing security.

SUMMARY OF THE INVENTION

This invention is a security mailbox which secures mail deposited therein from theft and protects its contents from the elements by having a receiving section including a receiving chamber for receiving mail through a mail delivery opening in its front end, a securing section including a securing chamber for receiving mail from the receiving chamber, and a teeter baffle separating the receiving chamber from the securing chamber. The securing chamber has an access door for selectively accessing delivered mail items secured therein. A portion including the access door is selectably attachable to the remainder of the mailbox such that the access door can be on the front or the back of the mailbox.

In a first embodiment, fasteners accessible only through the access door attach the top end of the securing section to the bottom end of the receiving section such that the access door end is on the front end of the mailbox or on said back end of the mailbox.

In a second embodiment, a door portion of the securing section that is about one half the height of the mailbox is selectively attachable to the upper portion of the mailbox.

Other features and many attendant advantages of the invention will become more apparent upon a reading of the following detailed description together with the drawings in which like reference numerals refer to like parts throughout.

DETAILED DESCRIPTION OF THE INVENTION

Figure 2:
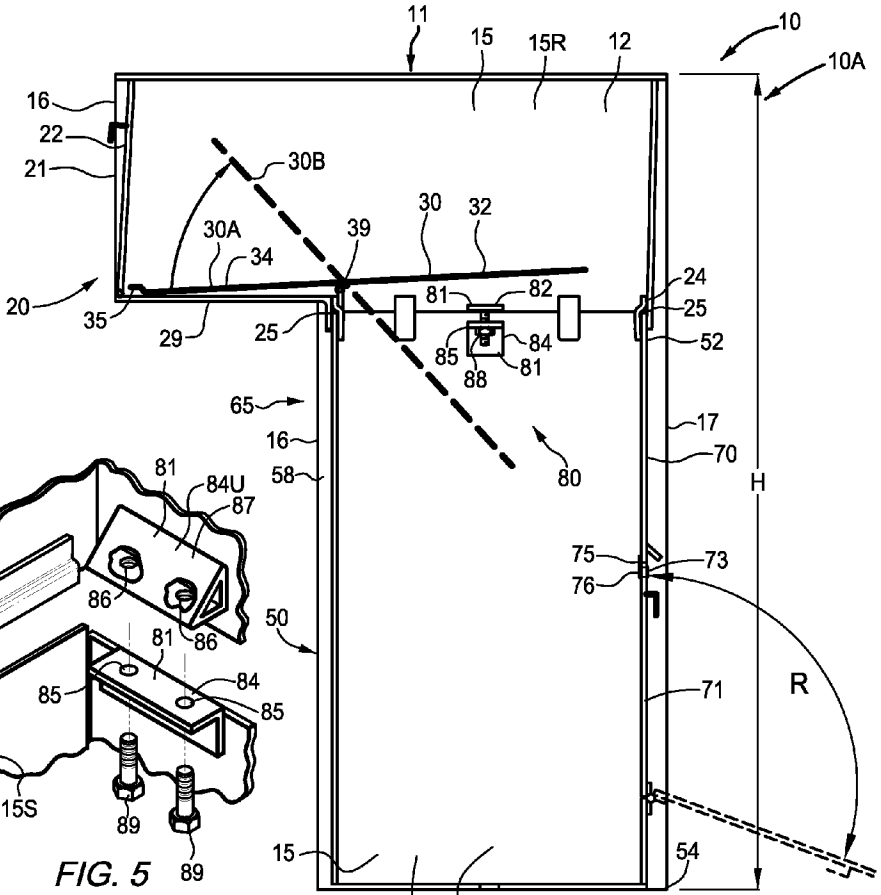
FIG. 2 is a vertical cross-sectional view of the embodiment of FIG. 1 except with the securing section attached such that the access door is on the back end.
Figure 1:
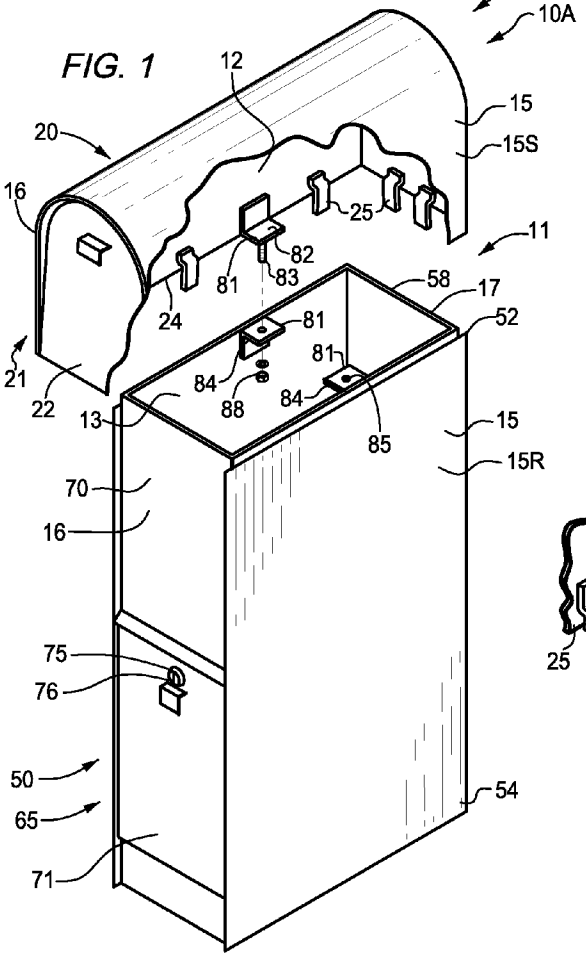
FIG. 1 is a front, top, left side, perspective view of a first embodiment of the security mailbox of the invention with the access door on the front end.

With reference now to the drawings, particularly FIGS. 1 and 2 thereof, there is shown, in FIG. 1 an exploded front, top, left side, perspective view of a first embodiment 10A of the security mailbox 10 of the invention, and in FIG. 2 a vertical cross-sectional view of the embodiment 10A of FIG. 1 except with a securing section 50 attached to a receiving section 20 such that an access door 71 is on the back end 17 of the mailbox 10.

Security mailbox 10A generally comprises an enclosure 11 having an receiving chamber 12 in a receiving section 20 adapted for receiving deliveries of mail, and a secured chamber 13 in a securing section 50 adapted for storing delivered mail and protecting it from theft or harsh weather conditions; and attachment means 80 selectively joining sections 20, 50. Mailbox 10 has a height H, a front end 16, a back end 17, and side walls 15.

Front end 16 of receiving section 20 includes a mail receiving opening 21, shown closed off by a hinged door 22, for receiving mail into receiving chamber 12. Receiving section 20 has receiving side wall 15R and a bottom end 24 selectively attached to securing section 50. Front end 16 of receiving section 20 overhangs securing section 50 sufficiently for receiving mail from a postal vehicle. Receiving section 20 is partially enclosed on its bottom end 24 by a bottom plate 29.

A teeter baffle 30 is pivotally mounted on a pivot axis, such as axis of hinge 39, and separates receiving chamber 12 from securing chamber 13. Teeter baffle 30 is pivotable between a receiving position 30A for receiving mail from opening 21 and a drop position 30B for dropping received mail into securing chamber 13. Teeter baffle 30 includes a back section 32 on the back side of hinge 39 adapted for controlling the communication of mail between receiving chamber 12 and securing chamber 13, and a front section 34 on the front side of hinge 39 having a front end 35 disposed proximal front end 16 when teeter baffle is in receiving position 30A. Teeter baffle 30 prevents a thief from reaching through receiving chamber to access mail in securing chamber 13.

Securing section 50 contains securing chamber 13 and includes a top end 52, a bottom end 54, securing side walls 15S, a door end 70, and an opposite end 58 opposite door end 70 Door end 70 includes an access door 71 having an upper end 73. Access door 71 is movable between an open position providing access to securing chamber 13 and a closed position preventing access to securing chamber 13. Access door 70 is shown hinged at the bottom so as to lie out of the way when accessing mail. The word "door" is used in a broad sense and is intended to cover other devices providing the same function, such as a slidable door or pivotable bin. Access door 70 includes locking means 75, such as a lock 76 integral with the closure mechanism, for restricting access. Locking means 75 may include a hasp integral with securing section 50 which extends through a slot in access door 70 adapted for use with an ordinary pad lock or combination lock.

Attachment means 80 provides for selectively attaching top end 52 of securing section 50 to bottom end 24 of receiving section 20 such that door end 70 is on front end 16 of enclosure 11 or on back end 17 of enclosure 11 as desired. In exemplary embodiment 10A, attachment means 80 includes a pair of brackets 81, such as stud brackets 82, each including a downward stud 83, on opposite inner faces of side walls 15S of bottom end 24 of receiving section 20, a pair of mating bore brackets 84, each having a bore for receiving a stud 83, and a pair of machine nuts 88 used as fasteners for attachment to studs 83. Typically, the brackets are attached by welding. Other attachment means 80 well-known in the art could be used. For example, a boss with a threaded bore could be used instead of stud bracket 82 such that a bolt could be used as a fastener from the bottom. Preferably, the attachment fasteners, such as nuts 88, are accessible only through access door 71.

Preferably, side walls 15R of bottom end 24 of receiving section 20 include means forming a channel 25 adapted for receiving side walls 15S of top end 52 of securing section 50 so there is no crack between attached sections 20, 50.

In FIG. 1, access door 71 is shown on front end 16 of mailbox 10A. It will now be appreciated that access door can easily, selectably, be positioned also on back end 17, as shown in FIG. 2.

Figure 5:
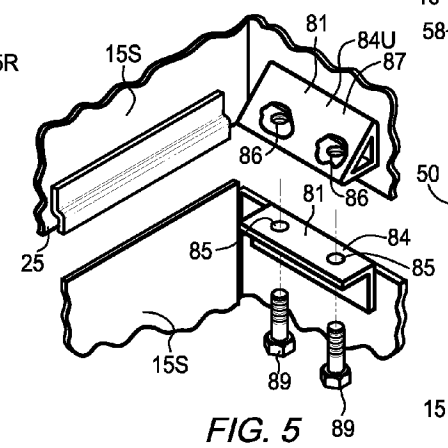
FIG. 5 is an enlarged, exploded, partial, perspective view of the fastening apparatus of FIGS. 3 and 4.
Figure 4:
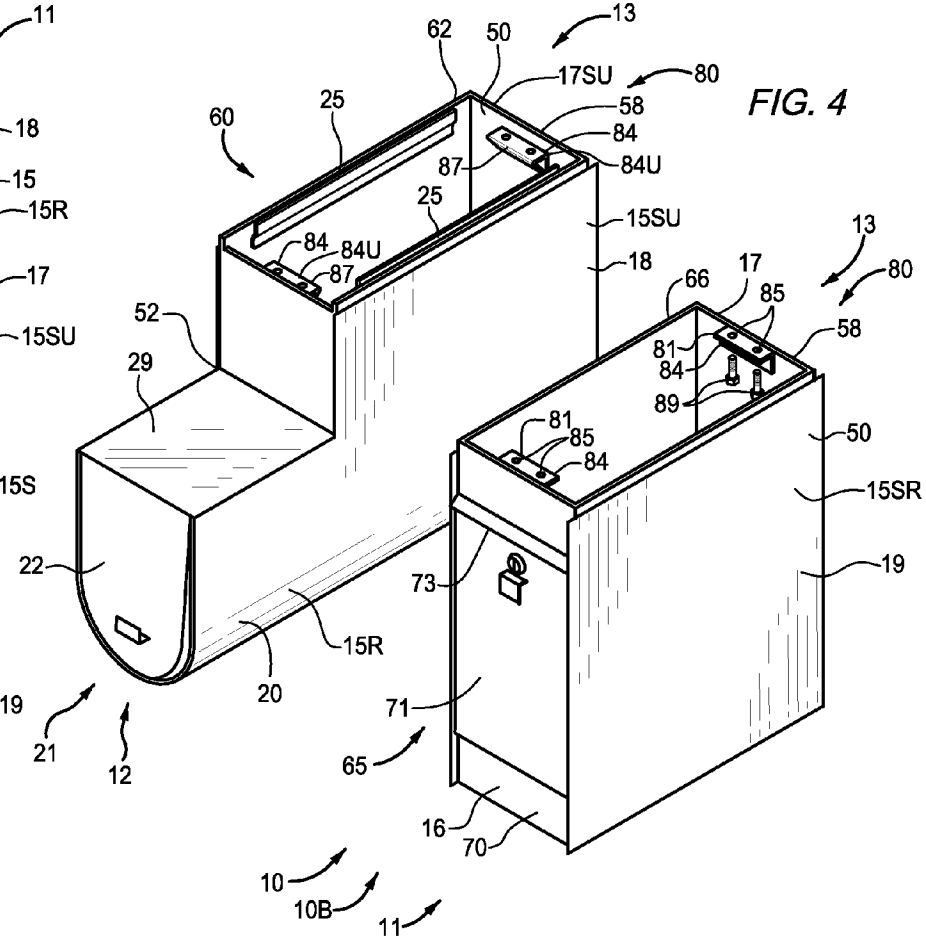
FIG. 4 is an exploded, partially cut away, perspective view of the embodiment of FIG. 3 in dismantled configuration for shipping.
Figure 3:
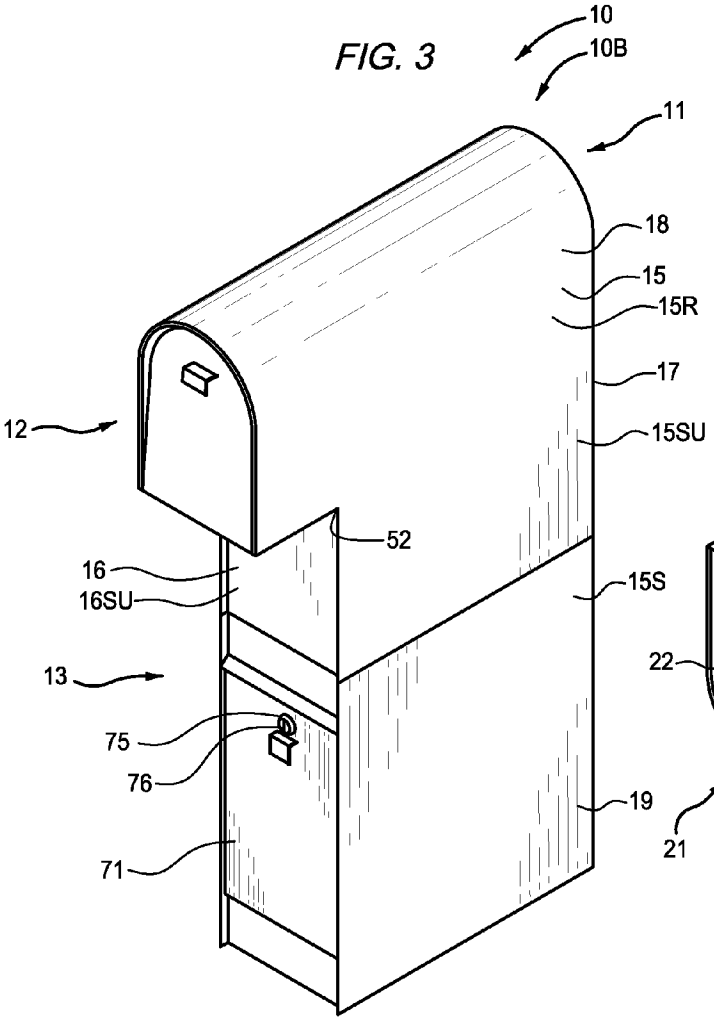
FIG. 3 is a front, top, left side, perspective view of a second embodiment of the security mailbox of the invention.

Turning now to FIGS. 3-5, FIG. 3 is a front, top, left side, perspective view of a second embodiment 10B of the security mailbox 10 of the invention, FIG. 4 is a partially exploded perspective view of the embodiment 10B of FIG. 3 shown in unattached configuration for shipping, and FIG. 5 is an enlarged, partial, exploded perspective view of the attachment means 80 of FIGS. 3 and 4 in position of attachment.

Mailbox 10B is similar to mailbox 10A except as described, except mailbox 10B is divided approximately in half so that each half, top half 18 and bottom half 19, each have a height of approximately one-half of height H of assembled mailbox 10 and such that a part of securing chamber 13 is in each half 18, 19. In FIG. 4, top half 18 is shown inverted relative to its orientation in the attached configuration of FIG. 3.

Securing section 50, which houses securing chamber 13, generally includes an upper portion 60 and a door portion 65. Top half 18 includes upper portion 60 and receiving section 20. Upper portion 60 includes side walls 15SU, a front end 16SU, a back end 17SU, a top end 52 attached to receiving section 20, and a lower end 62. Bottom half 19 includes a door portion 65 including an upper end 66, a door end 70, and an opposite end 58 opposite door end 70. Door end 70 includes an access door 71 having an upper end 73. Access door 71 is movable between an open position providing access to securing chamber 13 and a closed position preventing access to securing chamber 13. Access door 71 is shown hinged at the bottom so as to lie out of the way when accessing mail. The word "door" is used in a broad sense and is intended to cover other devices providing the same function, such as a slidable door or pivotable bin. Access door 70 includes locking means 75, such as a lock 76 integral with the closure mechanism, for restricting access. Locking means 75 may include a hasp integral with securing section 50 that extends through a slot in access door 71 adapted for use with an ordinary padlock or combination lock.

Attachment means 80 provides for selectively attaching upper end 66 of door portion 65 to lower end 62 of upper portion 60 such that door end 70 is attached to either front end 16 of enclosure 11 or on back end 17 of enclosure 11 as desired. In exemplary embodiment 10B, attachment means 80 on lower end 62 of upper portion 60 includes a pair of brackets 81 such as bore brackets 82, each including a threaded bore 86 on opposite end walls 16, 17. Attachment means 80 on upper end 66 of door portion 65 includes a pair of brackets 81, such as bore brackets 84, each including a free (unthreaded) bores 85, mounted on opposite end walls 16, 17. Bolts 89 pass through free bores 85 from the bottom and fasten into threaded bores 86 of upper bracket 84U. Alternatively, upper bracket 84U could be a stud bracket and described with respect to mailbox 10A, above. Preferably, the attachment fasteners are accessible only through access door 71. Preferably, a slanted wall, such as deflector plate 87, directs falling mail away from attachment means 80, such as bracket 81, so that the mail does not get hung up. Deflector plate 87 may be part of upper bracket 84U, as shown, or may be a separate element.

Preferably, side walls 15R of bottom end 62 of upper portion 60 include a channel 25 adapted for receiving side walls 15S of top end 66 of door portion 65 so there is no crack between attached sections 20, 50.

Having described the invention, it can be seen that it provides for an improved security mailbox that can be adapted for either front or back mail retrieval. An exemplary embodiment concurrently provides a more desirable shipping profile without sacrificing security.

Although particular embodiments of the invention have been illustrated and described, various changes may be made in the form, composition, construction, and arrangement of the parts without sacrificing any of their advantages. Therefore, it is to be understood that all matter herein is to be interpreted as illustrative and not in any limiting sense, and it is intended to cover in the appended claims such modifications as come within the true spirit and scope of the invention.

I claim:

1. An enclosure for receiving and securing items; said enclosure having a height, a front end, and a back end, said enclosure including:

a receiving section including:
- a receiving chamber;
- a front end on said front end of said enclosure including:
  - an item-receiving opening therein; and
  - a cooperating door;
- a back end on said back end of said enclosure;
- side walls; and
- a bottom end;

a securing section including:
- a securing chamber
- a top end;
- a bottom end;
- side walls;
- a door end including:
  - an access door including:
    - an upper end; said access door movable between an open position providing access to said securing chamber and a closed position preventing access to said securing chamber; and
- an opposite end opposite said door end;

attachment means for selectively attaching said top end of said securing section to said bottom end of said receiving section such that said door end is on said front end of said enclosure or on said back end of said enclosure; said attachment means including fastener means accessible only through said access door; and a teeter baffle pivotally mounted on a pivot axis and separating said chambers; said teeter baffle being pivotable between a receiving position for receiving items from said opening of said front end of said receiving chamber and a drop position for dropping received items into said securing chamber; said teeter baffle including:
- a back section on the back side of the pivot axis adapted for controlling the communication of items between said receiving chamber and said securing chamber; and a front section on the front side of the pivot axis having a bottom side and a front end disposed proximal said front end of said receiving chamber when said teeter baffle is in the receiving position.

2. The enclosure of claim 1 wherein:

said front end of said receiving section overhangs said securing section sufficiently for receiving mail from a postal vehicle.

3. The enclosure of claim 1 wherein:

said side walls of said bottom end of said receiving section include a channel adapted for receiving said side walls of said top end of said securing section.

4. An enclosure for receiving and securing items; said enclosure having a height, a front end, and a back end; said enclosure including:

an item-receiving section including:

a receiving chamber;

a front end on said front end of said enclosure including:

an item-receiving opening therein; and a cooperating door;

a back end on said back end of said enclosure;

side walls; and a bottom end;

an item-securing section including:

a securing chamber an upper portion including:

side walls;

a front end a back end;

a top end attached to said receiving section; and a lower end; and a door portion including:

an upper end;

a bottom end a door end including:

an access door including:

an upper end; said access door movable between an open position providing access to said securing chamber and a closed position preventing access to said securing chamber; and an opposite end opposite said door end;

attachment means for selectively attaching upper end of said door portion of said securing section to said lower end of said upper portion of said securing section such that said door end is on said front end of said enclosure or on said back end of said enclosure; said attachment means including fastener means accessible only through said access door;

a teeter baffle pivotally mounted on a pivot axis and separating said chambers; said teeter baffle being pivotable between a receiving position for receiving, items from said opening of said front end of said receiving chamber and a drop position for dropping received items into said securing chamber; said teeter baffle including:

a back section on the back side of the pivot axis adapted for controlling the communication of items between said receiving chamber and said securing chamber; and a front section on the front side of the pivot axis having a bottom side and a front end disposed proximal said front end of said receiving chamber when said teeter baffle is in the receiving, position.

5. The enclosure of claim 4 wherein:

said door portion is approximately one-half the height of said enclosure.

6. The enclosure of claim 4 wherein:

said front end of said receiving chamber overhangs said securing chamber sufficiently for receiving mail from a postal vehicle.

7. The enclosure of claim 4 wherein:

said side walls of said bottom end of said receiving section include a channel adapted for receiving said side walls of said top end of said securing section.

8. An enclosure for receiving and securing items; said enclosure having a height, a front end, and a back end, said enclosure including:

a receiving section including:

a receiving chamber;

a front end on said front end of said enclosure including:

an item-receiving opening therein; and a cooperating door;

a back end on said back end of said enclosure;

side walls; and a bottom end;

a securing section including:

a securing chamber a top end;

a bottom end;

side walls;

a door end including:

an access door including:

an upper end; said access door movable between an open position providing access to said securing chamber and a closed position preventing access to said securing chamber; and an opposite end opposite said door end;

attachment means for selectively attaching said top end of said securing section to said bottom end of said receiving section such that said door end is on said front end of said enclosure or on said back end of said enclosure; said side walls of said bottom end of said receiving section including a channel adapted for receiving said side walls of said top end of said securing section; and a teeter baffle pivotally mounted on a pivot axis and separating said chambers; said teeter baffle being pivotable between a receiving position for receiving items from said opening of said front end of said receiving chamber and a drop position for dropping received items into said securing chamber; said teeter baffle including:

a back section on the back side of the pivot axis adapted for controlling the communication of items between said receiving chamber and said securing chamber; and a front section on the front side of the pivot axis having a bottom side and a front end disposed proximal said front end of said receiving chamber when said teeter baffle is in the receiving position.

9. The enclosure of claim 8 wherein:

said front end of said receiving section overhangs said securing section sufficiently for receiving, mail from a postal vehicle.

10. The enclosure of claim 9 wherein:

said attachment means including fastener means accessible only through said access door.

11. An enclosure for receiving and securing items; said enclosure having a height, a front end, and a back end; said enclosure including:

an item-receiving section including:

a receiving chamber;

a front end on said front end of said enclosure including:

an item-receiving opening therein; and a cooperating door;

a back end on said back end of said enclosure;

side walls; and
a bottom end;
an item-securing section including:
a securing chamber
an upper portion including:
side walls;
a front end
a back end,
a top end attached to said receiving section; and
a lower end; and
a door portion including:
an upper end;
a bottom end;
a door end including:
an access door including:
an upper end; said access door movable between an open position providing access to said securing chamber and a dosed position preventing access to said seeming chamber; and
an opposite end opposite said door end;
attachment means for selectively attaching upper end of said door portion of said securing section to said lower end of said upper portion of said securing section such that said door end is on said front end of said enclosure or on said back end of said enclosure; said side walls of said bottom end of said receiving section including a channel adapted for receiving said side walls of said top end of said securing section;
a teeter baffle pivotally mounted on a pivot axis and separating said chambers; said teeter baffle being pivotable between a receiving position for receiving items from said opening of said front end of said receiving chamber and a drop position for dropping received items into said securing chamber; said teeter baffle including:
a back section on the back side of the pivot axis adapted for controlling the communication of items between said receiving chamber and said securing chamber; and
a front section on the front side of the pivot axis having a bottom side and a front end disposed proximal said front end of said receiving chamber when said teeter baffle is in the receiving position.

12. The enclosure of claim 11 wherein:
said door portion is approximately one-half the height of said enclosure.

13. The enclosure of claim 12 wherein:
said attachment means includes;
fastener means accessible only through said access door.

14. The enclosure of claim 13 wherein:
said door portion is approximately one-half the height of said enclosure.

15. The enclosure of claim 11 wherein:
said front end of said receiving chamber overhangs said securing chamber sufficiently for receiving mail from a postal vehicle.

* * * * *